US007841091B2

(12) United States Patent
Melton

(10) Patent No.: US 7,841,091 B2
(45) Date of Patent: Nov. 30, 2010

(54) BLADESET FOR A HAIR CUTTING APPARATUS

(75) Inventor: Scott A. Melton, Erie, IL (US)

(73) Assignee: Wahl Clipper Corporation, Sterling, IL (US)

( * ) Notice: Subject to any disclaimer, the term of this patent is extended or adjusted under 35 U.S.C. 154(b) by 320 days.

(21) Appl. No.: 11/985,516

(22) Filed: Nov. 15, 2007

(65) Prior Publication Data

US 2009/0126201 A1 May 21, 2009

(51) Int. Cl.
*B26B 19/06* (2006.01)

(52) U.S. Cl. ..... 30/223; 30/225

(58) Field of Classification Search ..... 30/208, 30/209, 223–225; D28/53
See application file for complete search history.

(56) References Cited

U.S. PATENT DOCUMENTS

| | | | | | |
|---|---|---|---|---|---|
| 1,780,276 | A | * | 11/1930 | Scheiwer | 30/223 |
| 1,791,228 | A | * | 2/1931 | Scheiwer | 30/225 |
| 1,908,385 | A | * | 5/1933 | Wahl | 30/225 |
| 1,939,253 | A | * | 12/1933 | Dremel | 30/223 |
| 2,035,632 | A | * | 3/1936 | Andis | 30/195 |
| 2,101,737 | A | | 12/1937 | Gesler | |
| 2,274,924 | A | * | 3/1942 | Hill | 30/225 |
| 2,279,102 | A | * | 4/1942 | Altemus | 30/225 |
| 2,470,287 | A | * | 5/1949 | Carter | 30/195 |
| 2,579,676 | A | * | 12/1951 | Kellogg et al. | 30/195 |
| 2,641,833 | A | | 6/1953 | Need | |
| 2,726,441 | A | * | 12/1955 | Brody | 30/30 |
| 2,738,579 | A | * | 3/1956 | Gent | 30/30 |
| 3,093,902 | A | * | 6/1963 | Andis | 30/223 |
| 3,161,954 | A | * | 12/1964 | Riley, Jr. et al. | 30/224 |
| 3,314,149 | A | * | 4/1967 | Kobler et al. | 30/222 |
| 3,711,948 | A | * | 1/1973 | Ford et al. | 30/233.5 |
| 4,020,549 | A | * | 5/1977 | Edwards | 30/30 |
| 4,118,863 | A | * | 10/1978 | Sandy | 30/195 |
| 4,557,050 | A | * | 12/1985 | Haraguchi et al. | 30/195 |
| 4,782,592 | A | | 11/1988 | Altamore | |
| 4,825,546 | A | * | 5/1989 | Araki et al. | 30/195 |
| 5,461,780 | A | * | 10/1995 | Morana | 30/30 |
| 5,794,348 | A | * | 8/1998 | Scott | 30/195 |
| 5,933,964 | A | * | 8/1999 | Altamore | 30/195 |
| 5,964,037 | A | * | 10/1999 | Clark | 30/223 |
| 6,073,350 | A | * | 6/2000 | Elston et al. | 30/225 |
| 6,658,740 | B2 | * | 12/2003 | Habben | 30/223 |
| 2004/0016128 | A1 | * | 1/2004 | Yanosaka et al. | 30/225 |

* cited by examiner

*Primary Examiner*—Jason Daniel Prone
(74) *Attorney, Agent, or Firm*—Greer, Burns & Crain, Ltd.

(57) ABSTRACT

A bladeset for a hair clipper includes at least one stationary blade having a plurality of stationary blade teeth, and at least one moving blade having a plurality of moving blade teeth and being configured for laterally reciprocating relative to the at least one stationary blade for cutting hair therebetween, the moving blade having a set of long teeth configured for cutting hair across a width of said moving blade, and a set of short teeth configured for cutting hair across said moving blade width when a clipper feed rate exceeds a given speed.

11 Claims, 2 Drawing Sheets

BLADESET FOR A HAIR CUTTING APPARATUS

BACKGROUND OF THE INVENTION

The present application relates to electric or battery-operated hair cutting appliances such as hair clippers, hair trimmers, and more particularly, to a bladeset for such devices.

Electric and battery-operated hair clippers are well known to hair styling professionals and laymen alike, and generally include a bladeset having a moving blade reciprocating with respect to a stationary blade. Typically, each blade has a row of teeth projecting from an edge along a width of the blade such that the opposing rows of the moving and stationary blades are arranged substantially parallel to and in contact with each other. While variations in blade tooth configuration are known, in some conventional hair clippers, the teeth on each blade extend approximately the same distance from their respective blades, such that the tips of the teeth generally define a straight line. Generally, V-shaped cavities are formed between adjacent blade teeth for receiving the hair to be cut.

During operation, a user or stylist moves the clipper through a customer's hair. As the clipper travels through the hair, hair strands enter spaces between the stationary blade teeth. As the moving blade reciprocates relative to the stationary blade, the hair strands are cut by the scissors action created between cutting edges of the moving and stationary blade teeth. An area of overlap between the stationary blade teeth and the moving blade teeth created during reciprocation is known in the art as the cutting zone.

The amount of hair that can enter the cutting zone is dependant in part upon the speed at which the clipper is moved through the hair. Accordingly, when the user moves the clipper through the hair at a slow rate, a relatively small amount of hair enters the cutting zone and can generally be cut by the blade teeth. However, when the user rapidly moves the clipper through the hair to be cut, the hair strands penetrate deeper into the cutting zone, allowing more strands to enter the cutting zone and requiring more strands to be cut in each reciprocating cycle. In current hair clippers, a common side effect of such rapid movement is that the bladeset becomes overloaded with hair, which can cause the blades to stall, separate or fail to properly cut the hair.

Hair clippers having a moving blade including long and short teeth alternately arranged along the blade have been developed but are typically not known to reduce these overload effects. Specifically, in the hair clipper in U.S. Pat. No. 2,641,833 to Need, a staggered tooth design is configured such that the long teeth cut half of the hair that enters the blade cavities, and the short teeth cut the remaining half, producing a two-tiered or feathered cut. Although the staggered tooth design in Need distributes the cutting load between the long and short teeth, the number of cuts per reciprocation of the moving blade is not changed, and accordingly, during increased clipper feed rates, hair can still overload or become caught in the blade cavities.

Accordingly, there is a need for an improved bladeset for a hair clipper that provides enhanced cutting performance at increased feed rates, as occurs when a clipper is moved relatively rapidly through the hair. There is a further need for an improved hair clipper bladeset that reduces the overload effects caused by such increased feed rates.

BRIEF SUMMARY OF THE INVENTION

The above-listed needs are met or exceeded by the present bladeset for a hair clipper, which features a moving blade having an increased density of teeth with respect to the stationary blade for providing more efficient hair cutting and reducing overload effects. In the preferred embodiment, there are at least twice as many teeth on the moving blade as on the stationary blade, enabling at least 1½ as many cutting actions per stroke than current hair clippers. The present bladeset also includes a moving blade having a staggered tooth design for distributing the cutting load across a width of the moving blade. In the preferred embodiment, the moving blade teeth have a substantially flat tip and a continuous square cross-section from root to tip for enabling hair to properly enter and remain within the cutting zone. In addition, an angle between respective cutting edges of the stationary blade teeth and the moving blade teeth is reduced due to the geometry of the teeth, further increasing cutting efficiency.

More specifically, the present bladeset for a hair clipper includes at least one stationary blade having a plurality of stationary blade teeth, and at least one moving blade having a plurality of moving blade teeth and being configured for laterally reciprocating relative to the at least one stationary blade for cutting hair therebetween, the moving blade having at least twice as many teeth as the stationary blade.

DETAILED DESCRIPTION OF THE INVENTION

Figure 1:
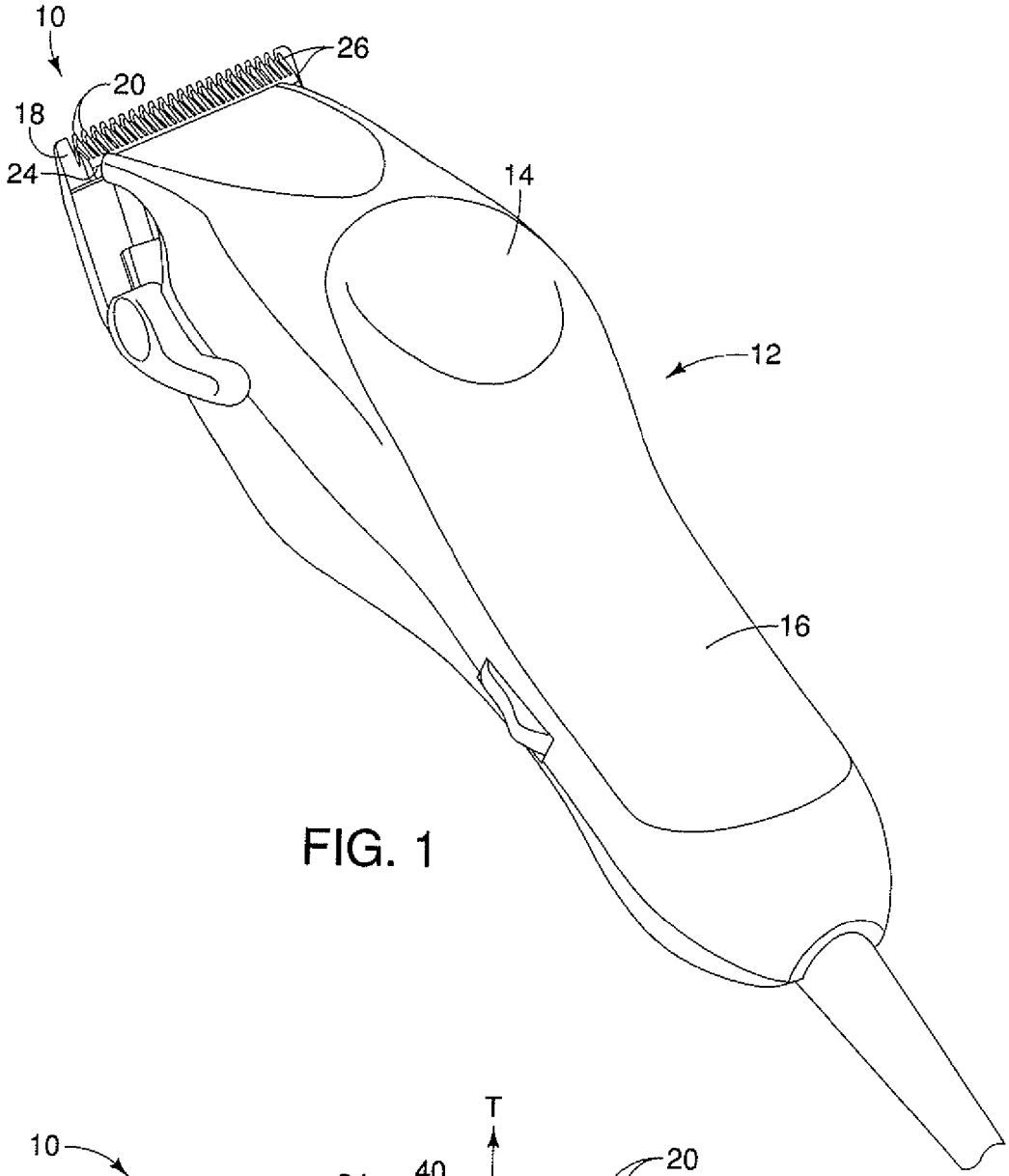
FIG. 1 is a perspective view of a hair clipper including a first embodiment of the present bladeset.

Referring now to FIG. 1, a hair clipper bladeset is provided and generally designated 10. As known in the art, the bladeset 10 is attached to a hair clipper 12 including a housing 14 having a generally elongate handle 16. The housing 14 generally encloses an electric motor and drive system (not shown) operatively connected to the bladeset 10.

Figure 2:
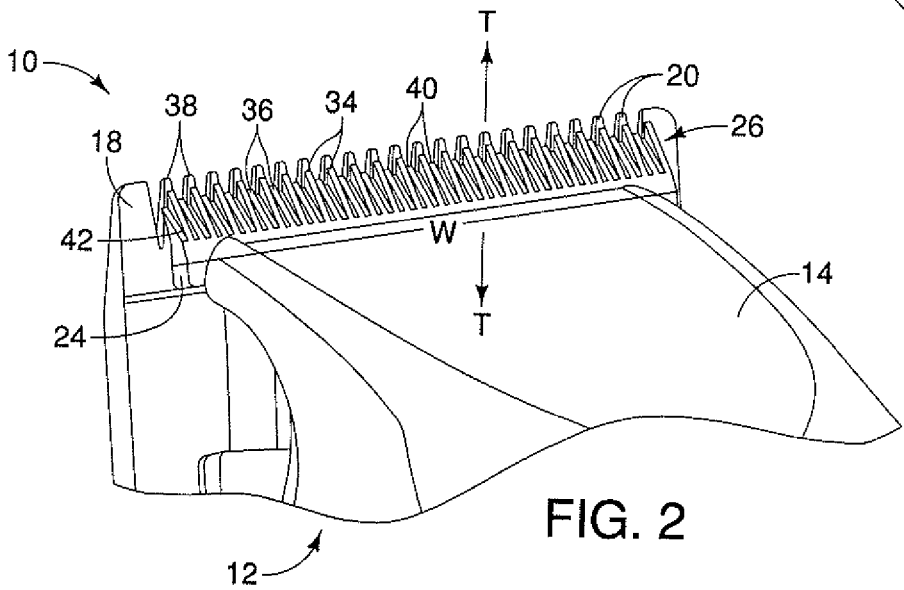
FIG. 2 is an enlarged fragmentary perspective view of the hair clipper shown in FIG. 1.
Figure 3:
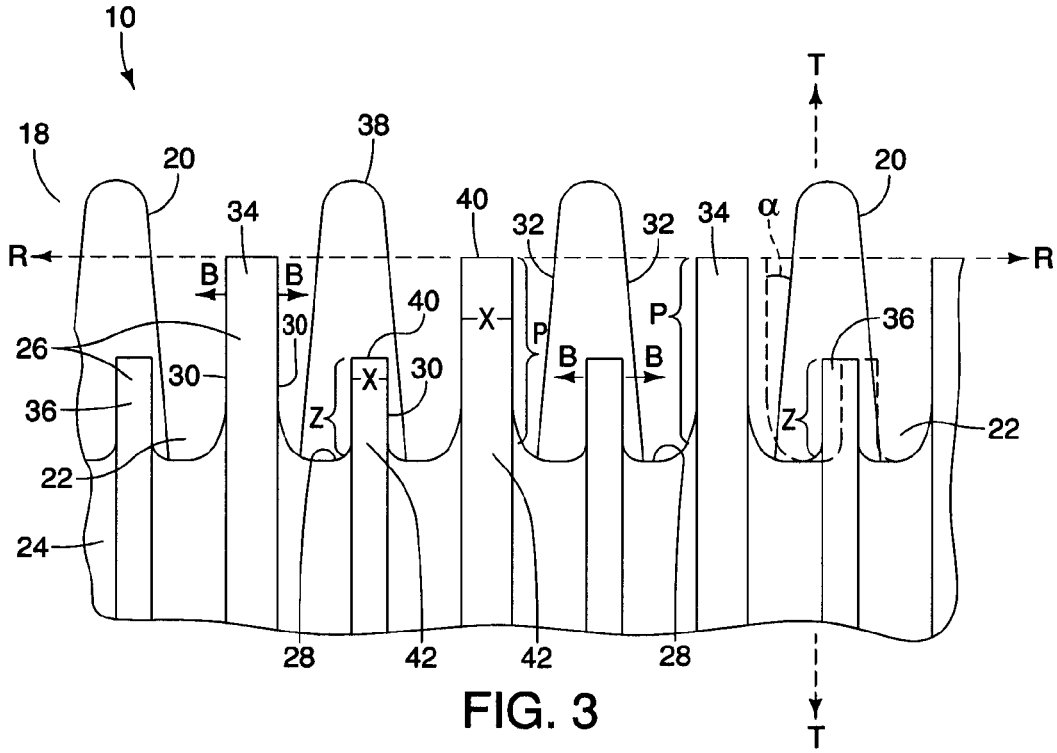
FIG. 3 is a fragmentary top view of the bladeset shown in FIG. 1.

As seen in FIGS. 1-3, the bladeset 10 includes at least one stationary blade 18 having a plurality of stationary blade teeth 20 defining stationary blade teeth cavities or spaces 22 between adjacent teeth, and at least one moving blade 24 having a plurality of moving blade teeth 26 defining moving blade teeth cavities or spaces 28 between adjacent teeth. The stationary blade 18 is connected to the housing 14 by any suitable fastening technology, such as screws or the like (not shown). The moving blade 24 is configured for laterally reciprocating relative to the stationary blade 18 for cutting hair therebetween in a scissors action, as is well known in the art. To enable hair cutting, the moving blade teeth 26 further include sides or cutting edges 30 that overlap corresponding stationary blade teeth sides or cutting edges 32 during reciprocation, creating a scissors action and cutting hair that has entered the stationary blade teeth cavities 22.

A feature of the present bladeset 10 is that the moving blade 24 has at least twice as many teeth 26 as the stationary blade 18. Specifically, in conventional bladesets, the moving blade typically has more teeth than the stationary blade teeth, but generally the moving blade tooth density is only slightly greater than that of the stationary blade. For example, in Need, the moving blade has approximately eighteen teeth, while the stationary blade has only seventeen teeth. However, in the present bladeset 10, the stationary blade 18 has approximately twenty-one stationary blade teeth 20, whereas the moving blade 24 has approximately forty-nine teeth 26.

When the moving blade 24 reciprocates relative to the stationary blade 18, the moving blade teeth 26 overlap the stationary blade teeth cavities 22. As hair enters the stationary blade teeth cavities 22, it is cut by the cutting edges 30, 32 as the moving blade teeth 26 reciprocate past the stationary blade teeth 20.

The moving blade teeth 26 of the present bladeset 10 include a plurality of long teeth 34 alternately arranged with a plurality of short teeth 36, the long and short teeth extending across a width "W" of the moving blade 24 (FIG. 2). Such a "staggered tooth" arrangement helps distribute the cutting load across the width "W" of the moving blade 24, reducing the likelihood of overloading the bladeset 10 when the clipper 12 is moved through a customer's hair at an increased speed. Specifically, the long teeth 34 are configured for cutting along the width "W" of the moving blade 24, and the short teeth 36 are configured for cutting along the moving blade width "W" when the clipper feed rate reaches a given speed.

Current hair clippers are typically constructed such that between 1-2 moving blade teeth overlap a corresponding one of the stationary blade teeth cavities during reciprocation. Because the moving blades of conventional hair clippers generally include between 23-25 teeth, it has been found that such hair clippers typically operate at 30-33 cutting actions per stroke. However, in the present hair clipper 12, although the moving blade teeth 26 are arranged such that approximately 1-2 moving blade teeth can overlap a corresponding one of the stationary blade teeth cavities 22 during reciprocation of the moving blade 24 (FIG. 3), because of the increased tooth density and staggered tooth arrangement, the long and short teeth 34, 36 are constructed and arranged for enabling more cutting actions during reciprocation, because the short teeth aid in hair cutting as the clipper feed rate is increased.

Specifically, the present hair clipper 12 results in over 45 cutting actions per stroke, allowing more hair to be cut in a single pass through the hair, with a constant clipper motor cutting speed in both units. However, it is recognized that other teeth densities may be suitable, depending on the application, as long as the moving blade 24 has staggered long and short teeth 34, 36 and a significantly greater tooth density than the stationary blade 18.

In conventional hair clippers, where the moving blade teeth are typically the same length, all of the hair moving through the bladeset and trapped in the stationary blade teeth cavities must be cut at the same time. When the feeding rate of the clipper is increased, hair penetrates deeper into the stationary blade teeth cavities, and there is a risk of overloading the bladeset with hair, which can cause the blades to separate, stall, or fail to cut properly. With the combination of the present staggered tooth design and the increased density of teeth on the moving blade 24 as discussed above, such risks are reduced during increased feed rates. The reason is that the cutting load is distributed such that the short teeth 36 cut some of the hairs, the long teeth 34 cut the remaining hairs, and the long and short teeth 34, 36 perform more cutting actions per stroke than conventional hair clippers, as described above.

Further, the increased density and staggered tooth arrangement of the present bladeset 10 is such that when feeding the clipper 12 at a normal or slower rate, the long teeth 34 provide a uniform length cut, even though the short teeth 36 are not being utilized. Similarly, when the clipper 12 is being fed through the hair at an increased feed rate, the long and short teeth 34, 36 provide a uniform length cut, because as described in further detail below, hair that is not cut by the short teeth is cut by the long teeth, and vice versa. This is in contrast to current bladesets, such as that disclosed in Need, where the staggered tooth design creates a jagged cut because of the decreased density of the moving blade teeth.

Unlike conventional bladesets where the moving blade teeth are typically the same length and form a single cutting zone where the moving blade teeth overlap the stationary blade teeth, the present bladeset 10 includes two cutting zones. Specifically, referring to FIG. 3, the stationary blade teeth 20 extend beyond the short teeth 36, forming a first horizontally or laterally oriented cutting zone "Z" in an area where the short teeth and the stationary blade teeth overlap, the first cutting zone extending in length to the stationary blade teeth cavities 22. Further, the stationary blade teeth 20 extend beyond the long teeth 34, forming a second cutting zone "P" in an area where the long teeth and the stationary blade teeth overlap, the second cutting zone extending in length to the stationary blade teeth cavities 22. Accordingly, as seen in FIG. 3, the second cutting zone P overlaps the first cutting zone Z, enabling hair that is not cut within the first cutting zone to be cut within the second cutting zone, and vice versa, if hair passes through the second cutting zone without being cut.

As the clipper 12 is passed through the hair at an increased rate, hair penetrates deeper into the cutting zone, requiring more hair to be cut in a single pass through the hair. This can cause the bladeset in conventional hair clippers to be overloaded with hair, preventing all of the hair from being cut. It has been found that when the present bladeset 10 is utilized during increased clipper feed rates, hair that is not cut by the short teeth 36 in the first cutting zone Z will be cut by the long teeth 34 in the second cutting zone P, and vice versa, enabling the hair to be cut to a uniform length.

This is in contrast to the bladeset disclosed in Need, where the staggered tooth design produces a "zig-zag" shaped cutting zone, resulting in a feathered look to the hair being cut. Specifically, in Need, as the clipper is moved through the hair, because of the relatively low tooth density of the moving blade, half of the hair received in the blade teeth cavities is cut to a first length by the long teeth of the moving blade. The remaining half of the hair received in the blade teeth cavities is cut to a second length by the short teeth of the moving blade, resulting in two separate lengths of hair, hence the "feathered" or "zig-zag" look.

Referring still to FIG. 3, preferably each of the stationary blade teeth 20 includes a substantially rounded tip 38 to aid in hair feeding, and each of the moving blade teeth 26 include a substantially flat tip 40. To permit hair to enter and remain within the cutting zones Z, P, the moving blade cutting edges 30 are arranged substantially perpendicular to an axis of reciprocation "R" of the moving blade 24, such that the moving blade teeth 26 have a continuous square cross-section B-B taken along a width "x" of each of the teeth, the width x being substantially parallel to the axis of reciprocation R. Preferably, the square cross-section B-B extends from a root 42 to the tip 40 of the teeth. Such a construction reduces an angle $\alpha$ defined at a point of overlap between the moving blade teeth cutting edges 30 and the stationary blade teeth cutting edges 32 (shown in phantom in FIG. 3 to indicate reciprocation of the moving blade 24 relative to the stationary blade 18) in comparison to conventional bladesets.

Specifically, in current bladesets, the angle $\alpha$ between the cutting edges of the moving blade teeth and the stationary blade teeth is approximately 14°. It has been found that this relatively large angle reduces the area between adjacent teeth, thereby reducing the area in which the hair can enter the cutting zone. In contrast, in the present bladeset 10, the stationary blade teeth cutting edges 32 are arranged obliquely to a transverse axis "T" of the stationary blade 18, defining the angle α of between 3-7° with a corresponding one of the moving blade teeth cutting edges 30.

By reducing the angle α between the cutting edges 30, 32, hair strands can more easily enter the cutting zones Z, P because the reduced angle provides more room between adjacent teeth. Rather, the hair that enters the stationary blade teeth cavities 22 enters the cutting zones Z, P and is cut by the stationary blade cutting edges 32 due to the reciprocating moving blade teeth 26, enabling hair to be cut by the scissors action of the cutting edges 30, 32 when the moving blade teeth 26 overlap the stationary blade teeth 20.

Figure 4:
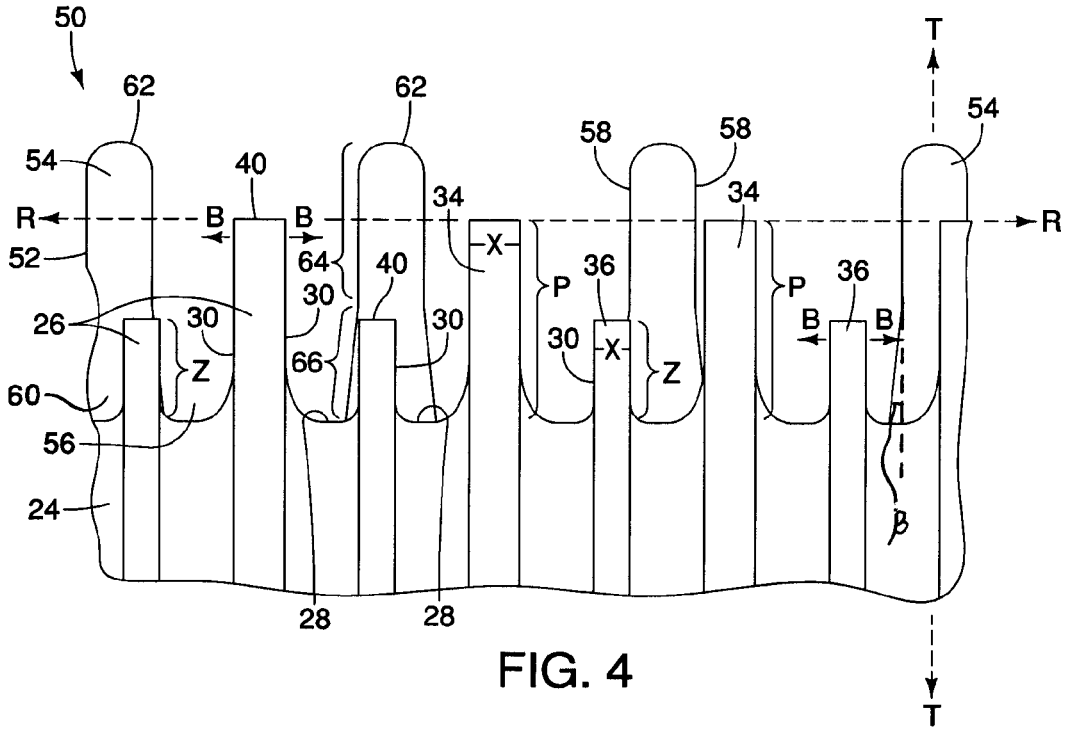
FIG. 4 is a fragmentary top view of a second embodiment of the present bladeset.

An alternate embodiment of the bladeset is shown in FIG. 4 and is generally designated 50. Shared components of the bladeset 10 and the bladeset 50 are identified with like reference numbers. The bladeset 50 includes the moving blade 24 constructed and arranged for reciprocating laterally with respect to a stationary blade 52 having a plurality of stationary blade teeth 54 defining stationary blade teeth cavities or spaces 56 between adjacent teeth. The stationary blade teeth 54 each have two cutting edges 58, a root 60 and a substantially rounded tip 62. A first portion 64 is located closer to the tip 62 and is substantially parallel to the transverse axis "T" of the stationary blade 52, and a second portion 66 is located closer to the root 60 and is arranged obliquely to the transverse axis. In the first portion 64, the cutting edges 58 are substantially straight, parallel sides that form a square cross-section B-B taken along a width "x" of each of the teeth, the width x being substantially parallel to the axis of reciprocation R. The cutting edges 58 are also substantially parallel to the cutting edges 30 of the moving blade teeth 26. In the second portion 66, the cutting edges 58 are arranged at an angle β, preferably in a range of 3-7° relative to the transverse axis "T" of the stationary blade 18, forming a substantially tapered shape that extends to the stationary blade teeth cavities 56.

The construction of the stationary blade teeth 54 further reduces the angle α between the cutting edges 30, 58, because the cutting edges 58 of the first portion 64 of each of the stationary blade teeth 54 are substantially parallel to a corresponding one of the moving blade teeth cutting edges 30. Accordingly, by further reducing the angle between the cutting edges 30, 58, hair can more easily enter and remain within the cutting zones Z, P, enabling more hair to be cut and increasing cutting efficiency.

Thus, it will be seen that the present hair clipper bladeset 10 reduces the above-discussed hair overload effects caused by increased clipper feed rates by providing a moving blade 24 having at least twice as many teeth as the stationary blade 18. In the present bladesets 10, 50, the moving blade teeth 26 include two distinct sets of teeth, each constructed and arranged for covering the respective cutting zones Z, P. The moving blade 24 includes alternating long and short teeth 34, 36 to further reduce overload effects and increase cutting efficiency by distributing the cutting load across the width of the blade. In addition, the angle α between the moving blade teeth cutting edges 30 and the stationary blade teeth cutting edges 32 is reduced in comparison to conventional hair clipper bladesets, further enabling hair to enter and remain within the cutting zone.

While a particular embodiment of the bladeset for a hair clipper has been described herein, it will be appreciated by those skilled in the art that changes and modifications may be made thereto without departing from the invention in its broader aspects and as set forth in the following claims.

The invention claimed is:

1. A bladeset for a hair clipper, comprising:

at least one stationary blade having a plurality of stationary blade teeth; and at least one moving blade having a plurality of moving blade teeth and being configured for laterally reciprocating relative to said at least one stationary blade for cutting hair therebetween, said moving blade teeth including a plurality of long teeth alternately arranged with a plurality of short teeth, said plurality of long teeth and said plurality of short teeth each being configured to cut across at least an entire width of said moving blade at relatively high hair feed rates; and said stationary blade teeth are each separated by a stationary blade teeth cavity and wherein a horizontally oriented first cutting zone is formed in an area where said short teeth and said stationary blade teeth cavities overlap, and a second horizontally oriented cutting zone is formed in an area where said long teeth and said stationary blade teeth cavities overlap, said first and second cutting zones extending along the entire width of said moving blade, and said cutting zones overlapping each other, so that said first cutting zone is within said second cutting zone, such that said short teeth and said long teeth cut hair in the same area of the bladeset at said high hair feed rates.

2. The bladeset of claim 1 wherein each of said moving blade teeth includes a substantially flat tip and has a continuous square cross-section taken along a width of each of said moving blade teeth and extending from a root to a tip of said moving blade teeth.

3. The bladeset of claim 1 wherein each of said stationary blade teeth includes a substantially rounded tip and has a square cross-section taken along a width of each of said stationary blade teeth.

4. The bladeset of claim 1 wherein each of said moving blade teeth includes a pair of sides arranged substantially perpendicular to an axis of reciprocation of said moving blade.

5. The bladeset of claim 4 wherein each of said stationary blade teeth includes a pair of sides arranged obliquely to a transverse axis of said stationary blade, and each of said stationary blade teeth sides defining an angle in the range of 3-7° with a corresponding one of said moving blade teeth sides when said moving blade teeth sides overlap said stationary blade teeth sides.

6. The bladeset of claim 4 wherein each of said stationary blade teeth includes a root, a substantially rounded tip, a first portion located closer to said tip being substantially parallel to a transverse axis of said stationary blade, and a second portion located closer to said root being arranged obliquely to a transverse axis of said stationary blade.

7. The bladeset of claim 6 wherein said first portion of each of said stationary blade teeth is substantially parallel to a corresponding one of said moving blade teeth sides.

8. The bladeset of claim 1, wherein said bladeset and said first and second cutting zones are constructed and arranged such that hair not cut in said first zone is cut in said second zone, resulting in hair being cut at a uniform length, even at said relatively high hair feed rates.

9. A bladeset for a hair clipper, comprising:

at least one stationary blade having a plurality of stationary blade teeth each having a substantially rounded tip; and at least one moving blade having a plurality of moving blade teeth and being configured for laterally reciprocating relative to said at least one stationary blade for cutting hair therebetween, said moving blade teeth including a plurality of long teeth alternately arranged with a plurality of short teeth, each of said long and short teeth having a substantially flat moving blade tip and a continuous square cross-section from a root to said moving blade tip, said moving blade has at least twice as many teeth as said stationary blade;

where said stationary blade teeth are each separated by a stationary blade teeth cavity, and wherein a first cutting zone is formed in an area where said short teeth and said stationary blade teeth cavities overlap, and a second cutting zone is formed in an area where said long teeth and said stationary blade teeth cavities overlap, said first and second cutting zones being parallel to each other and extending along a width of said moving blade, said first zone being included in said second zone;

wherein said long teeth are configured for cutting hair across at least an entire width of said moving blade, and said short teeth are configured for cutting hair across at least an entire moving blade width when hair is fed to said bladeset at relatively high feed rates.

10. The hair clipper of claim 9 wherein each of said moving blade teeth and said stationary blade teeth includes a pair of sides arranged substantially perpendicular to an axis of reciprocation of said moving blade.

11. The hair clipper of claim 9, wherein said bladeset is constructed and arranged to operate at least 45 cutting actions per stroke.

* * * * *